US009670030B2

(12) United States Patent
Kim

(10) Patent No.: US 9,670,030 B2
(45) Date of Patent: Jun. 6, 2017

(54) BOBBIN

(71) Applicant: LSIS CO., LTD., Anyang-si, Gyeonggi-do (KR)

(72) Inventor: Eung Nam Kim, Jeonju-si (KR)

(73) Assignee: LSIS CO., LTD., Anyang-si (KR)

( * ) Notice: Subject to any disclaimer, the term of this patent is extended or adjusted under 35 U.S.C. 154(b) by 223 days.

(21) Appl. No.: 14/524,452

(22) Filed: Oct. 27, 2014

(65) Prior Publication Data

US 2015/0175385 A1 Jun. 25, 2015

(30) Foreign Application Priority Data

Dec. 19, 2013 (KR) ..... 20-2013-0010594 U

(51) Int. Cl.
*B65H 75/14* (2006.01)
*H01F 5/02* (2006.01)

(52) U.S. Cl.
CPC ..... *B65H 75/14* (2013.01); *H01F 5/02* (2013.01)

(58) Field of Classification Search
CPC .. B65H 75/141; B65H 75/146; B65H 75/148; H01F 27/28
USPC ..... 242/322
See application file for complete search history.

(56) References Cited

U.S. PATENT DOCUMENTS 2,535,746 A * 12/1950 Mitchell ..... A01K 89/06 242/118.4
2,709,051 A * 5/1955 Bunch ..... B65H 67/04 242/580
3,895,333 A 7/1975 Cressman
4,076,185 A * 2/1978 Dorph ..... A01K 89/0111 242/118.41
4,269,371 A * 5/1981 Kovaleski ..... B65H 75/148 242/118.6

(Continued)

FOREIGN PATENT DOCUMENTS

CN 2198655 5/1995
CN 102623251 8/2012

(Continued)

OTHER PUBLICATIONS

State Intellectual Property Office of the People's Republic of China Application Serial No. 201410802583.X, Office Action dated May 26, 2016, 6 pages.

(Continued)

*Primary Examiner* — Emmanuel M Marcelo
(74) *Attorney, Agent, or Firm* — Lee, Hong, Degerman, Kang & Waimey

(57) ABSTRACT

This specification relates to a bobbin wound with a wire. The bobbin disclosed herein includes a winding main body on which a wire is wound, and a flange section that protrudes from both end portions of the winding main body to form an accommodation space of the wire, wherein the winding main body includes a first winding portion and a second winding portion that are arranged such that central axes thereof are aligned with each other, and configured to be stepped from each other due to a difference of diameters thereof, and a stopping jaw that protrudes from a winding portion with a relatively great diameter of the first winding portion and the second winding portion, whereby the wire can be prevented from being fallen down or loosened while being wound.

11 Claims, 7 Drawing Sheets

(56) References Cited

U.S. PATENT DOCUMENTS

| | | | | | |
|---|---|---|---|---|---|
| 4,406,419 | A * | 9/1983 | Kotzur | B65H 54/10 | 242/163 |
| 4,667,896 | A * | 5/1987 | Frey | B65H 75/18 | 242/118.41 |
| 4,904,975 | A | 2/1990 | Medenbach | | |
| 5,161,751 | A * | 11/1992 | Bolcavage | A01K 89/0111 | 242/322 |
| 6,031,443 | A | 2/2000 | Larsen | | |
| 6,412,724 | B1 * | 7/2002 | Ferrara, Jr. | A01K 89/016 | 242/317 |
| 6,467,712 | B1 * | 10/2002 | Cribb | A01K 89/00 | 242/322 |
| 6,938,847 | B1 * | 9/2005 | Yeh | A01K 89/0111 | 242/322 |
| 2007/0138330 | A1 * | 6/2007 | Ellis | B65H 75/148 | 242/388.1 |
| 2011/0095124 | A1 * | 4/2011 | Andrea | B65H 49/18 | 242/474.8 |

FOREIGN PATENT DOCUMENTS

| | | |
|---|---|---|
| CN | 103426688 | 12/2013 |
| JP | 2009-54937 | 3/2009 |

OTHER PUBLICATIONS

State Intellectual Property Office of the People's Republic of China Application Serial No. 201410802583.X, Office Action dated Feb. 3, 2017, 6 pages.

* cited by examiner

BOBBIN

CROSS-REFERENCE TO RELATED APPLICATION

Pursuant to 35 U.S.C. §119(a), this application claims the benefit of earlier filing date and right of priority to Korean Application No. 20-2013-0010594, filed on Dec. 19, 2013, the contents of which are all hereby incorporated by reference herein in its entirety.

BACKGROUND OF THE DISCLOSURE

1. Field of the Disclosure

This specification relates to a bobbin on which a wire can be evenly wound.

2. Background of the Disclosure

In general, a magnetic contactor is a device for switching on or off an electric circuit.

The magnetic contactor may include a contact part and an electromagnetic part.

The contact part may directly disconnect or connect the electric circuit.

The electromagnetic part may provide a driving force for controlling an operation of the contact part.

The electromagnetic part may include a bobbin, a movable core and stationary core.

The bobbin may be provided with a coil.

The movable core may be mechanically connected to a movable contact.

When external power is applied to the coil, a magnetic field may be formed around the coil.

In response to the formation of the magnetic field, the movable core may be attracted toward the stationary core, thereby turning on the contact part.

FIG. 1 is a side view illustrating a structure of a bobbin according to the related art, and FIG. 2 is a sectional view taken along the line II-II of FIG. 1. As illustrated in FIG. 1, the bobbin includes a winding section 10 and flanges 20.

The winding section 10 may include a first winding portion 11 and a second winding portion 12 which are connected to each other in a stepped state due to a difference of their diameters.

The flanges 20 may protrude from each end portion of the first winding portion 11 and the second winding portion 12.

One of the flanges 20 may be provided with coil terminals 21 located adjacent to corners thereof.

One end portion of a wire may be connected to one of the coil terminals 21.

The wire may be wound on the winding section 10, starting from the second winding portion 12 having a great diameter to the first winding portion 11.

The wire may be initially wound in a spiral direction on the first winding portion 11 and the second winding portion 12 in an alternating manner.

However, the following problems are brought about upon winding the wire in the related art.

For example, while the wire is wound, it is wound on the winding section 10 into several layers. When the wire is moved from the first winding portion 11 having a small diameter to the second winding portion 12 having a great diameter, it is wound up along a stepped jaw of the second winding portion 12. During this, the winding may be slipped down or fallen down. Accordingly, the wire may lose its evenly-wound shape and get tangled without being tightly wound.

As aforementioned, due to the winding being slipped down or getting tangled while winding the wire, the coil may have an extremely increased resistance value. This may result in dissatisfaction of a standard-compliable coil resistance value, a deviation of the coil resistance value and the like.

Also, due to the winding being slipped down or getting tangled, the wire and the coil terminal 21 may be likely to be disconnected from each other.

SUMMARY OF THE DISCLOSURE

Therefore, to overcome those problems of the related art, an aspect of the detailed description is to provide a bobbin capable of satisfying a standard of a coil resistance value by preventing a winding from being slipped down or getting tangled upon winding the wire.

To achieve these and other advantages and in accordance with the purpose of this specification, as embodied and broadly described herein, there is provided a bobbin including a winding main body and a flange section.

The winding main body may be formed in a cylindrical shape.

A wire may be wound on an outer surface of the winding main body.

The flange section may protrude from both end portions of the winding main body in an outer diameter direction.

The flange section may block a section of the winding main body in an axial direction at both end portions of the winding main body, so as to form an accommodation space of the wire.

The winding main body may include a first winding portion and a second winding portion having different diameters from each other.

The first winding portion and the second winding portion may be arranged such that their central axes are aligned with each other.

The first winding portion and the second winding portion may be connected with being stepped from each other due to a difference of diameters thereof.

The stopping jaw may protrude from the second winding portion having a relatively great diameter, of the first and second winding portions.

In accordance with a first exemplary embodiment disclosed herein, the stopping jaw may be located at an end of one of the first and second winding portions selected.

The stopping jaw may be continuously formed on an outer circumferential surface of the second winding portion having the relatively great diameter along a circumferential direction.

The stopping jaw may be provided with an opening formed at one side thereof, and the wire may be inserted through the opening to be stopped by the stopping jaw.

In accordance with a second exemplary embodiment disclosed herein, a plurality of stopping jaws may be arranged, with being spaced from one another along a circumferential direction, on an outer circumferential surface of the second winding portion having the relatively great diameter.

Here, the wire may be wound from the first winding portion having the small diameter to the second winding portion in a manner of getting over the stopping jaw.

The second winding portion having the relatively great diameter may further include an auxiliary stopping jaw formed with being spaced from the stopping jaw in the axial direction.

The stopping jaw may be integrally formed with one of the first and second winding portions selected.

One of the first and second winding portions selected may be provided with a slot that is recessed into an outer circumferential surface thereof. The stopping jaw may be provided with an insertion portion that protrudes from an inner circumferential surface thereof so as to be inserted into the slot.

In such a manner, when a wire is wound on a bobbin disclosed herein, the wire may be stopped by a stopping jaw, such that a winding of the wire can be prevented from being fallen down or getting tangled. This may result in satisfying a coil resistance value required, and minimizing the worry about disconnection of the wire.

When the stopping jaw is formed at a stepped portion, the wire may be prevented from being slipped down to a winding portion having a small diameter while the wire is wound by getting over a winding portion having a great diameter from the winding portion having the small diameter.

When the stopping jaw is formed along a circumferential direction, the wire can be easily stopped at any side of the stepped portion of a winding main body.

When the wire is inserted into an opening provided at one side of the stopping jaw, the winding of the wire can be further prevented from being slipped or fallen down.

When a plurality of stopping jaws are arranged along a circumferential direction in a spacing manner, the insertion of the wire between the stopping jaws may be more facilitated, thereby much tensely maintaining an initially-wound state of the winding.

If an auxiliary stopping jaw is further provided, the wire may be located between the stopping jaw and the auxiliary stopping jaw, a left-to-right movement of the wire in an axial direction can be prevented, which may result in preventing the winding of the wire from being loosened.

When the stopping jaw is integrally formed with the winding main body, rigidity of the winding main body may be further increased.

When the stopping jaw is coupled in an inserting manner into the slot, the stopping jaw can be designed to have various widths, thereby enhancing design flexibility.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments disclosed herein to facilitate for the practice of those person skilled in the art to which the present disclosure belongs, with reference to the accompanying drawings.

Figure 3:
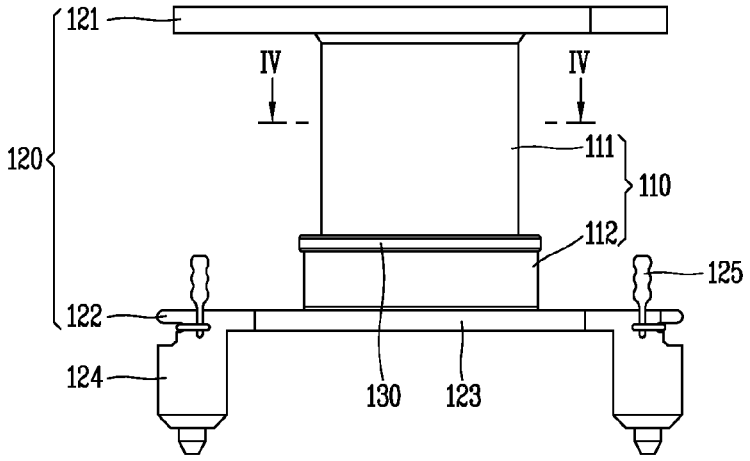
FIG. 3 is a side view illustrating a structure of a bobbin in accordance with a first exemplary embodiment disclosed herein.
Figure 4:
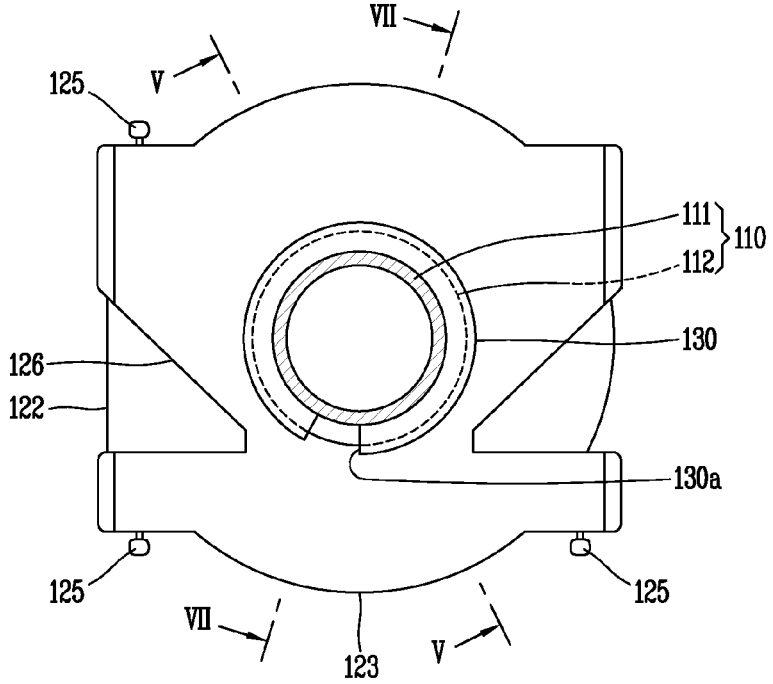
FIG. 4 is a sectional view taken along the line IV-IV of FIG. 3.

FIG. 3 is a side view illustrating a structure of a bobbin in accordance with a first exemplary embodiment disclosed herein, and FIG. 4 is a sectional view taken along the line IV-IV of FIG. 3.

The present disclosure relates to a bobbin capable of preventing a winding from being fallen down or getting tangled.

The bobbin may be applied to a magnetic contactor, for example.

Upon being applied to the magnetic contactor, the bobbin may be used as a partial component of an electromagnetic part which is equipped as a power source for turning on a contact part or maintaining the turn-on state.

The bobbin may be provided with a winding main body 110 and a flange section 120.

The winding main body 110 may be formed in a cylindrical shape.

The winding main body 110 may be provided with a hollow portion formed therethrough.

A rotational shaft may be inserted through the hollow portion.

The rotational shaft may be rotatably coupled to the winding main body 110 into an integral form.

Both end portions of the rotational shaft may be rotatably supported by bearings.

The rotational shaft may be connected to an actuator, such as a motor or the like.

The winding main body 110 may receive power through the rotational shaft.

A wire 140 may be wound on the winding main body 110.

The wire 140 may be wound into a spiral form.

The winding main body 110, as illustrated in FIG. 3, may be disposed such that a central axis thereof is perpendicular to the wire 140 when the wire 140 is wound thereon.

The winding main body 110 may be disposed such that the central axis thereof is horizontal to the wire 140 when the wire 140 is wound thereon.

The winding main body 110 may be provided with a first winding portion 111 and a second winding portion 112.

The first winding portion 111 and the second winding portion 112 may be formed in a cylindrical shape.

The first winding portion 111 and the second winding portion 112 may have different diameters from each other.

The second winding portion 112 may have a diameter which is relatively greater than that of the first winding portion 111.

The first winding portion 111 and the second winding portion 112 may be arranged such that their central axes are aligned with each other.

The first winding portion 111 and the second winding portion 112 may be connected to each other in a stepped state.

The flange section 120 may be provided with a first flange portion 121 and a second flange portion 122.

The first flange portion 121 may protrude from an outer end portion of the first winding portion 111 in a direction that its diameter increases.

The first flange portion 121 may block the outer end portion of the first winding portion 111 to limit a section of the first winding portion 111 in an axial direction of the first winding portion 111.

The second flange portion 122 may protrude from an outer end portion of the second winding portion 112 in a direction that its diameter increases.

The second flange portion 122 may block the outer end portion of the second winding portion 112 to limit a section of the second winding portion 112 in an axial direction of the second winding portion 112.

The flange section 120 may block a section of the winding main body 110 in the axial direction so as to form an accommodation space of the wire 140.

The wire 140 may be accommodated in the accommodation space.

The wire 140 may be provided with three strands.

The first flange portion 121 may have a structure of a rectangular plate.

The second flange portion 122 may also have a structure of a rectangular plate.

Figure 1:
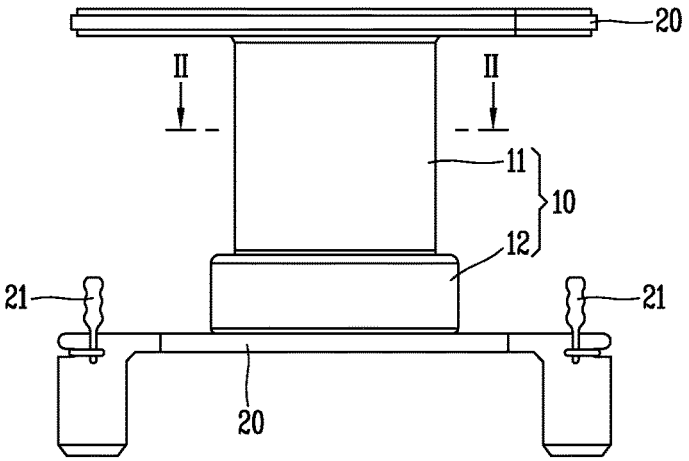
FIG. 1 PRIOR ART
FIG. 1 is a side view illustrating a structure of a bobbin according to the related art.
Figure 2:
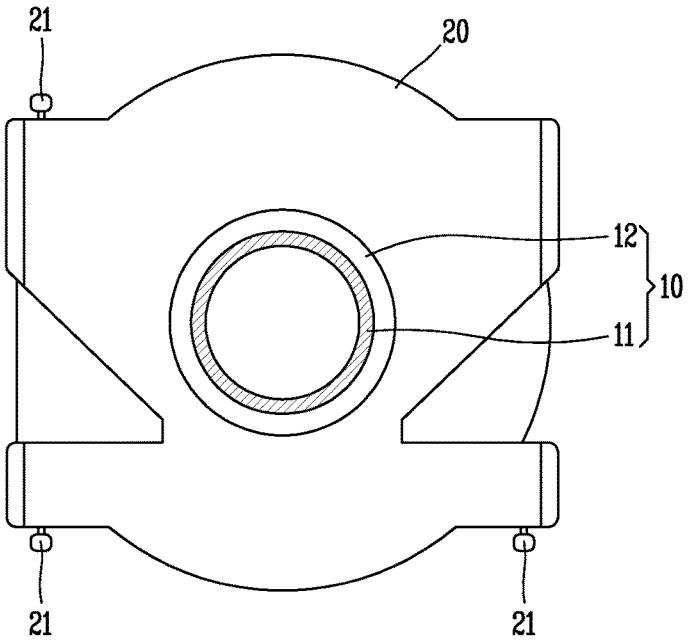
FIG. 2 PRIOR ART
FIG. 2 is a sectional view taken along the line II-II of FIG. 1.

The second flange portion 122, as illustrated in FIG. 2, may be provided with circular protrusions 123 which convexly protrude from both outer side surfaces, which face each other, of side surfaces thereof.

The second flange portion 122 may be provided with protrusion members 124 which protrude adjacent to at least two corners thereof.

The protrusion member 124 may have a structure of a rectangular pipe.

The protrusion member 124 may be formed in a shape similar to a shape.

The second flange portion 122 may be provided with a plurality of coil terminals 125 which are made of a conductive material and coupled to the second flange portion 122 at positions adjacent to the corners of the second flange portion 122.

The coil terminals 125 may be fixed at three positions adjacent to the corners of the second flange portion 122.

The three strands of the wire 140 may be fixed to the respective coil terminals, which are provided on the second flange portion 122 in the spacing manner.

Two of the three strands of the wire 140 which have been selected may first be wound, and the other one strand of the wire 140 may be later wound.

Wire fixing grooves may be provided at the side surfaces of the second flange 122.

The wire fixing grooves may be disposed adjacent to the coil terminals 125.

The second flange portion 122 may be provided with recesses 126 which are recessed into an inner side surface thereof.

The recesses 126 may be formed in a shape of a right-angled triangle.

The recesses 126 may be disposed such that a vertex portion of the triangle faces an opening 130*a* of a stopping jaw 130 which will be explained later.

The recesses 126 may be formed symmetrical to each other based on a central line of the winding main body 110 in a diameter direction of the winding portion.

The recess 126 may connect both neighboring sides of the right-angled triangle to the wire fixing groove.

The wire 140 may be guided by the wire fixing grooves and the vertex portions of the recesses 126 while its one end portion is fixed to the coil terminal 125.

The wire 140 may wound, starting from the second winding portion 112.

The wire 140 may be initially wound on the first winding portion 111 and the second winding portion 112 in an alternating manner.

The wire 140 may be spirally wound on the first winding portion 111 and the second winding portion 112.

The wire 140 may be moved from the second winding portion 112 to the first winding portion 111 while it is wound.

The wire 140 may be moved from the first winding portion 111 and the second winding portion 112 when it is wound.

Here, the wire main body may be provided with a stopping jaw 130 at the second winding portion 112.

The second winding portion 112 may have a greater diameter than the first winding portion 111.

A length of the first winding portion 111 in an axial direction may be longer than that of the second winding portion 112 in the axial direction.

A length of the second winding portion 112 in the axial direction may be within a range of 20 to 90% of a total length of the first winding portion 111 and the second winding portion 112 in the axial direction.

After the wire 140 is wound on an outer circumferential surface of the winding main body 110, the stopping jaw 130 may restrict the movement of the wire 140 in the axial direction.

The stopping jaw 130 may be located at an end of the second winding portion 112.

The stopping jaw 130 may be located at an end of the second winding portion 112 at a position adjacent to the first winding portion 111.

The stopping jaw 130 may be continuously formed on the outer circumferential surface of the second winding portion 112 along a circumferential direction.

The stopping jaw 130 may be formed in an annular shape.

The stopping jaw 130 may have a semicircular section.

The stopping jaw 130 may be provided with an opening 130*a* which is located at a partial section of a closed loop thereof, for example, a partial section of a circular curve.

The opening 130*a* may be formed by partially cutting off the annular stopping jaw 130.

The opening 130*a* of the stopping jaw 130 may be formed within the range of 5 to 20% of an entire circumferential length of the stopping jaw 130.

The wire 140 may be inserted through the opening 130*a* of the stopping jaw 130.

The wire 140 may be inclinedly inserted into the opening 130*a* of the stopping jaw 130 in a diagonal direction.

Accordingly, the wire 140 may be wound from the first winding portion 111 to the second winding portion 112 or from the second winding portion 112 to the first winding portion 111.

Figure 5:
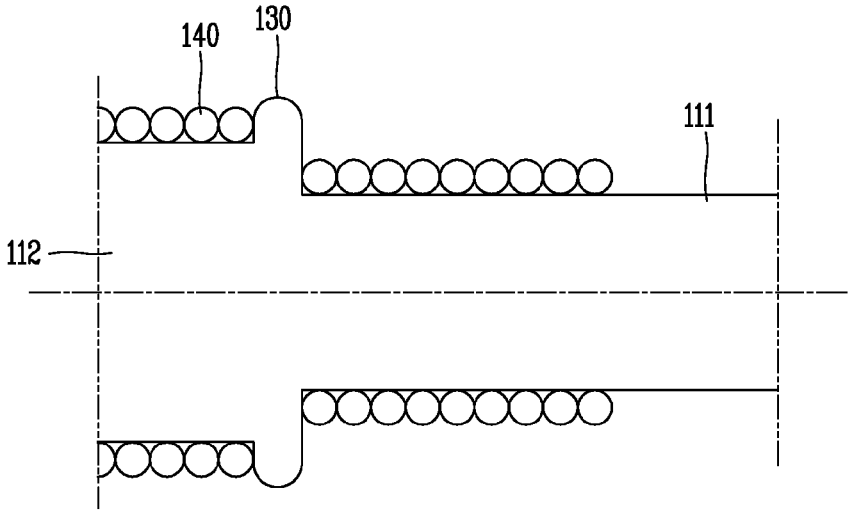
FIG. 5 is a sectional view taken along the line V-V of FIG. 4, which shows a state that a wire is wound on a winding main body into a single layer at an initial winding.
Figure 6:
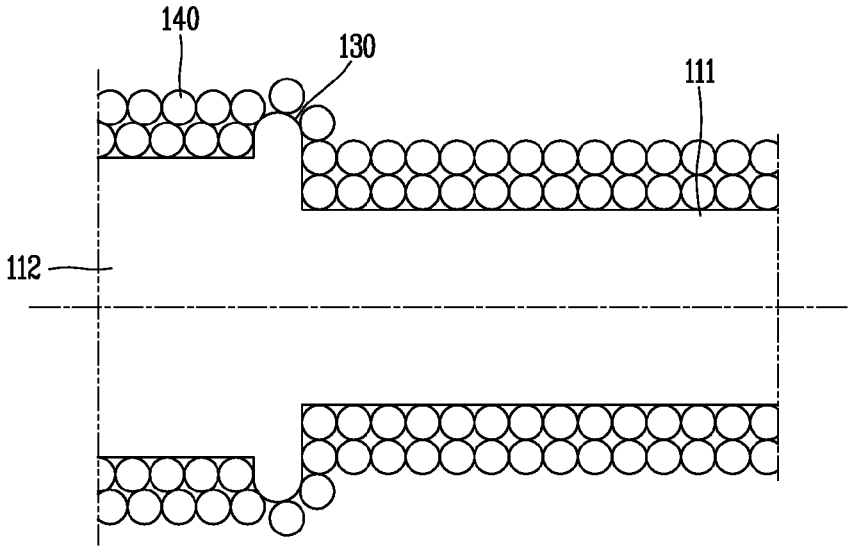
FIG. 6 is a sectional view taken along the line V-V of FIG. 4, which illustrates a state that the wire is wound on the winding main body into two layers at the initial winding.

FIG. 5 is a sectional view taken along the line V-V of FIG. 4, which shows a state that the wire 140 is wound on the winding main body into a single layer at an initial winding, and FIG. 6 is a sectional view taken along the line V-V of FIG. 4, which illustrates a state that the wire 140 is wound on the winding main body into two layers at the initial winding.

Upon being wound in a spiral direction, the wire 140 may be wound to intersect with the stopping jaw 130, namely, to partially overlap the stopping jaw 130.

If it is assumed that a winding speed of the wire 140 which is wound on a winding main body without a stopping jaw according to the related art is the same as a winding speed of the wire 140 which is wound on the winding main body with the stopping jaw 130 according to the present disclosure, a tensile force applied to the wire 140 when the wire 140 is wound may increase in proportion to a protruded degree and a thickness of the stopping jaw 130, which protrudes from the outer circumferential surface of the winding portion, as compared with the winding main body without the stopping jaw. Therefore, the wire 140 can be wound more tightly (tensely) than the related art even without being inserted through the opening 130*a* of the stopping jaw 130.

Also, if the number of turns is the same as each other, a diameter of the wire 140 which is wound to overlap (get over) the stopping jaw 130 may be greater than a diameter of the wire 140 which is wound on a portion of the outer circumferential surface of the second winding portion 112 without the stopping jaw 130. This may prevent the wire 140, at the initial winding moment, from being fallen down to one side or loosened based on the stopping jaw 130, while being moved from the second winding portion 112 having the greater diameter to the first winding portion 111 having the small diameter or vice versa.

In the related art, at the initial winding, when the wire 140 is axially moved from the first winding portion 111 having the small diameter to the second winding portion 112 having the great diameter, a height of the second winding portion 112 may interfere with the axial movement of the wire 140. Accordingly, the winding of the wire 140 may be fallen down or loosened toward the side with the small diameter.

On the other hand, although the stopping jaw 130 disclosed herein is higher than the diameter of the existing second winding portion 112, a thickness (width) of the stopping jaw 130 is much shorter than the length of the second winding portion 112 in the axial direction. Therefore, while the wire 140 gets over the stopping jaw 130, the wire 140 which has passed a peak (the highest point in a diameter direction) of the stopping jaw 130 is stopped due to the stopping jaw 130. This may prevent or interfere with a reverse movement (from a side with a great diameter to a side with a small diameter) of the wire 140.

Also, the tensile force applied to the wire 140 may increase in proportion to the protruded degree of the stopping jaw 130, and thus the wire 140 can be pulled tensely.

Figure 7:
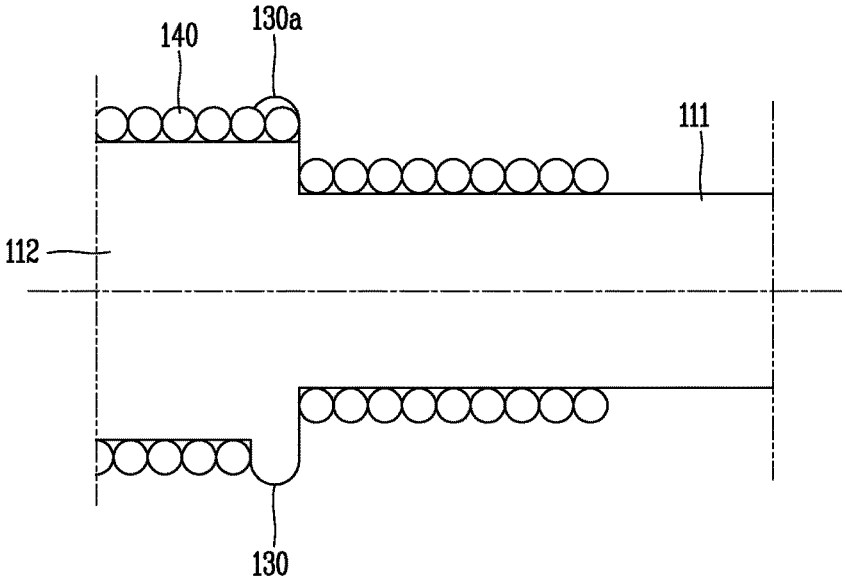
FIG. 7 is a sectional view taken along the line VII-VII of FIG. 4, which illustrates a state that the wire is wound on the winding main body into a single layer at the initial winding.
Figure 8:
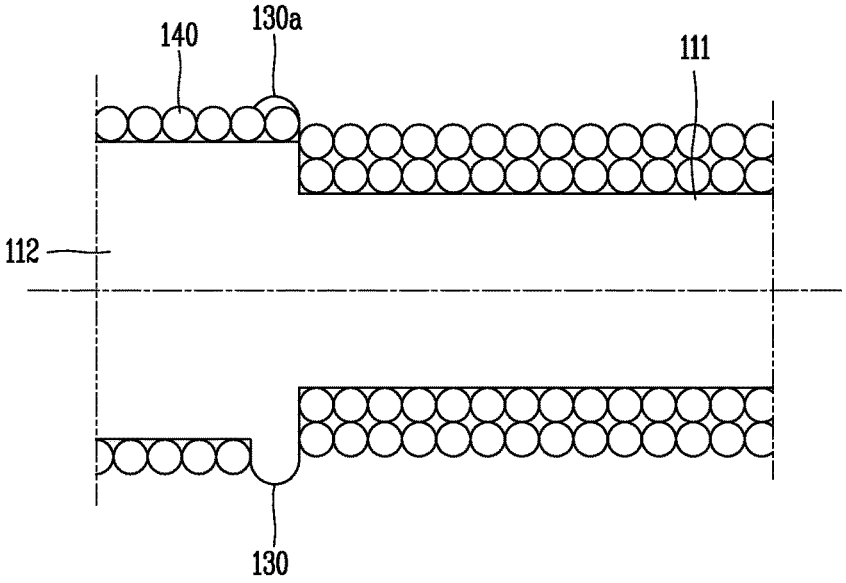
FIG. 8 is a sectional view taken along the line VII-VII of FIG. 4, which illustrates a state that the wire is wound on the winding main body into two layers.

FIG. 7 is a sectional view taken along the line VII-VII of FIG. 4, which illustrates a state that the wire 140 is wound on the winding main body into a single layer at the initial winding, and FIG. 8 is a sectional view taken along the line VII-VII of FIG. 4, which illustrates a state that the wire 140 is wound on the winding main body into two layers.

The wire 140 may be inserted through the opening 130*a* of the stopping jaw 130 upon being spirally wound on the winding main body.

When the wire 140 is inserted through the opening 130*a* of the stopping jaw 130, the wire 140 may be stopped by coming in contact with one end portion or another end portion of the stopping jaw 130 in the vicinity of the opening 130*a*, thereby restricting the movement of the wire 140.

For example, the wire 140 may be spirally wound along the outer circumferential surface of the winding portion, and thus be inserted through the opening 130*a* in a diagonal direction with being inclined with respect to an axial direction.

The wire 140 may be inserted through the opening 130*a* from a left side based on the stopping jaw 130 and an upper side based on a central line in the axial direction to a right bottom.

Here, when the tensile force is applied to the wire 140 in the axial direction from the first winding portion 111 to the second winding portion 112 or from the second winding portion 112 to the first winding portion 111, the wire 140 may be stopped by one end portion or another end portion of the stopping jaw 130 in the vicinity of the opening 130*a*, thereby being restricted from being moved in the axial direction.

In such a manner, the wire 140 may be restricted from being moved in the circumferential and axial directions, such that the winding of the wire 140 can be more reliably prevented from being fallen down or loosened when it is moved from the first winding portion 111 to the second winding portion 112.

That is, the wire 140 which is inserted through the opening 130*a* of the stopping jaw 130 may be more firmly wound than a wire which is not inserted through the opening 130*a*.

Therefore, according to the present disclosure, with the formation of the stopping jaw 130 in the protruding manner on the second winding portion 112 having the great diameter, the reverse movement of the wire 140 can be restricted, which may result in preventing the wire 140 from being tumbled and loosened.

By preventing the wire 140 from being tumbled and loosened, a required coil resistance value may be reduced, thereby satisfying a resistance standard.

Here, the bobbin according to the first exemplary embodiment disclosed herein has the structure that the stopping jaw 130 is integrally formed with the winding portion.

The stopping jaw 130 according to the first exemplary embodiment may be integrally formed with the winding portion through injection molding.

A bobbin according to a second exemplary embodiment disclosed herein may be provided with a detachable stopping jaw 130.

Figure 9:
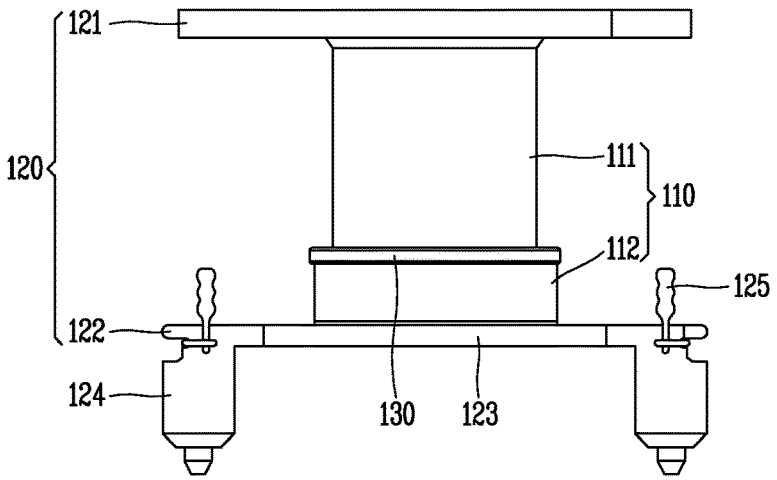
FIG. 9 is a side view illustrating a structure of a bobbin in accordance with a second exemplary embodiment disclosed herein.
Figure 10:
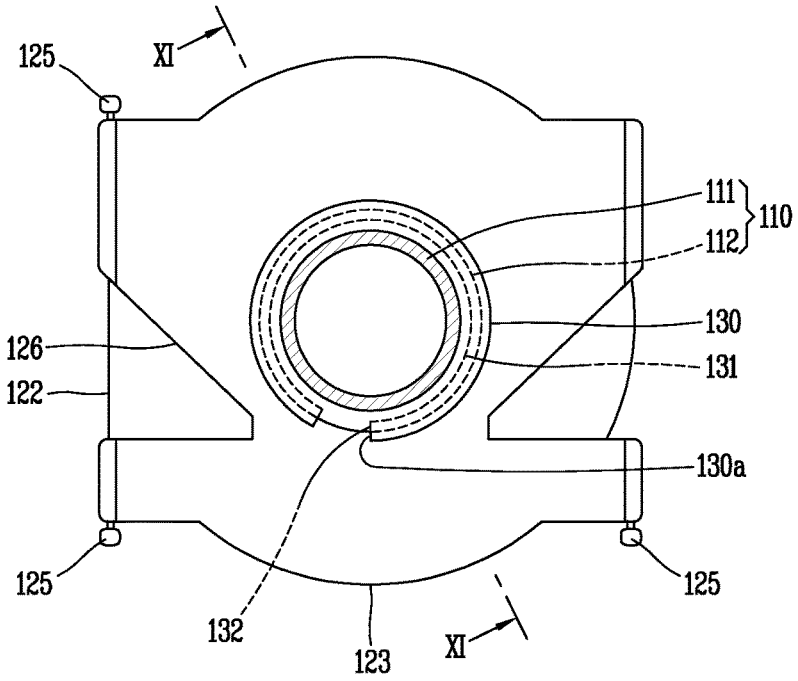
FIG. 10 is a sectional view taken along the line X-X of FIG. 9.
Figure 11:
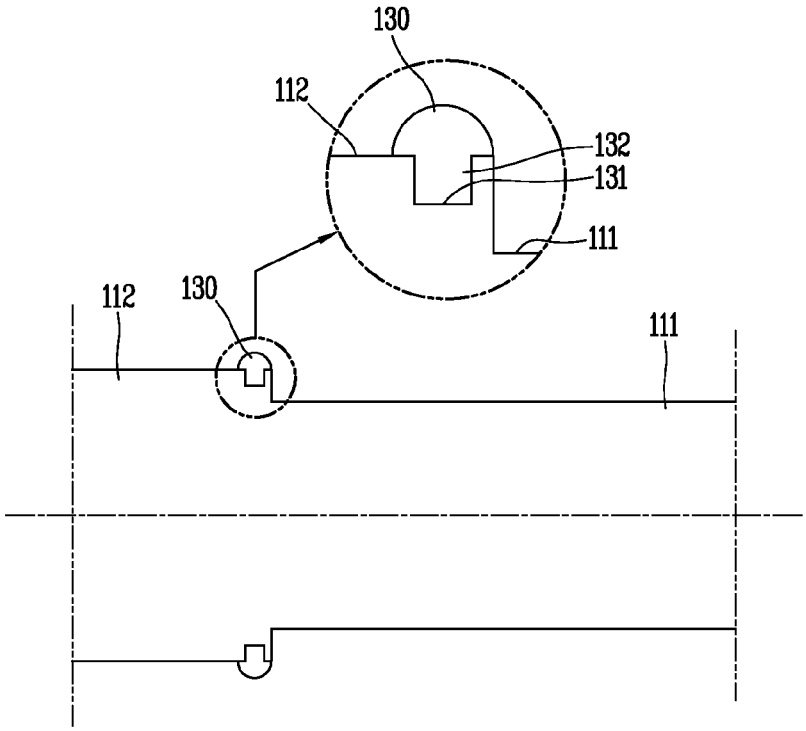
FIG. 11 is a sectional view taken along the line XI-XI of FIG. 10.

FIG. 9 is a side view illustrating a structure of a bobbin in accordance with a second exemplary embodiment disclosed herein, FIG. 10 is a sectional view taken along the line X-X of FIG. 9, and FIG. 11 is a sectional view taken along the line XI-XI of FIG. 10.

The stopping jaw 130 may be molded, separate from the winding portion.

The stopping jaw 130 may have a ring-shaped structure.

The stopping jaw 130 may be provided with an opening 130*a*, such that a partial portion of a closed loop, namely, the annular stopping jaw 130 is open.

The stopping jaw 130 may be configured such that both end portions thereof are spaced from each other by the opening 130*a*.

An open length of the opening 130*a* may be 5 to 50% of an entire length of the stopping jaw 130.

The winding main body 110 may be provided with a slot 131 which is recessed along an outer circumferential surface of the second winding portion 112.

The slot 131 may be configured such that a length thereof is relatively longer than a width.

The width of the slot 131 may be similar to or slightly narrower than a thickness of the stopping jaw 130.

The slot 131 may be formed in a shape of a groove in which the stopping jaw 130 is inserted.

The length of the slot 131 may be slightly shorter than the length of the stopping jaw 130.

The stopping jaw 130 may be coupled to the slot 131 by an insertion portion 132.

The insertion portion 132 may protrude from an inner circumferential surface of the stopping jaw 130 in a shape of a protrusion.

The insertion portion 132 may be inserted into the slot 131.

The stopping jaw 130 may be coupled to the slot 131 by the insertion of the insertion portion into the slot 131. This may restrict the movement of the stopping jaw 130 in an axial direction and a circumferential direction on the outer circumferential surface of the second winding portion 112.

The slot 131 may be formed at one end of the second winding portion 112.

The slot 131 may not be formed at a partial section of the outer circumferential surface of the second winding portion 112, in which the stopping jaw 130 is not inserted.

Both end portions of the slot 131 may be stepped with respect to the second winding portion 112 due to a diameter difference, thereby further restricting the movement of the insertion portion and the stopping jaw in the circumferential direction.

The stopping jaw 130 and the winding main body of the bobbin may be fabricated as separate structures.

Figure 12:
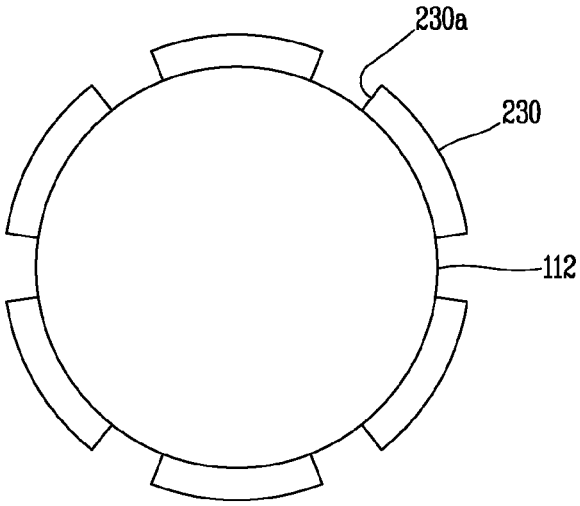
FIG. 12 is a schematic view illustrating another exemplary embodiment of a stopping jaw disclosed herein.

FIG. 12 is a schematic view illustrating another exemplary embodiment of a stopping jaw disclosed herein.

As illustrated in FIG. 12, a plurality of stopping jaws 230 may be formed, with being spaced from one another along a circumferential direction, on an outer circumferential surface of the second winding portion 112 having the relatively great diameter.

Figure 13:
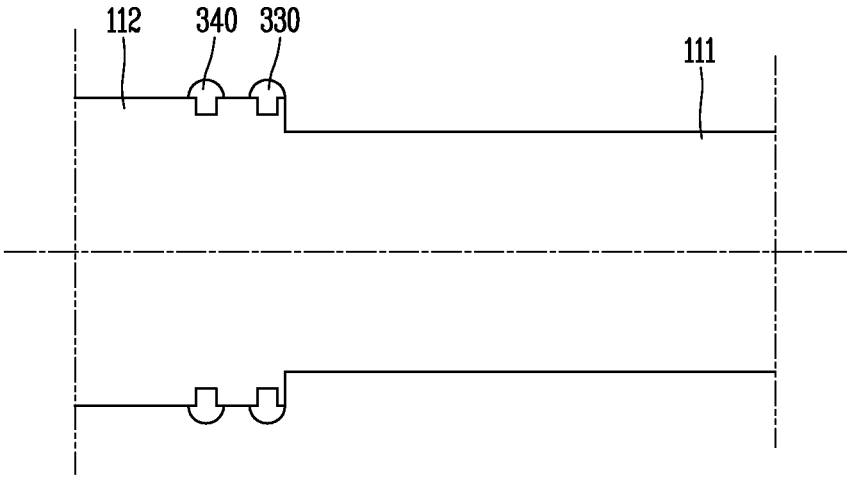
FIG. 13 is a schematic view illustrating another exemplary embodiment of a stopping jaw disclosed herein.

FIG. 13 is a schematic view illustrating another exemplary embodiment of a stopping jaw disclosed herein.

As illustrated in FIG. 13, a pair of stopping jaws 330 and 340 may be provided on the second winding portion 112. The stopping jaws 330 and 340 may include a stopping jaw 330 formed at an end of the second winding portion 112 and an auxiliary stopping jaw 340 spaced from the stopping jaw 330 in an axial direction.

When the stopping jaw 130 is produced as a separate structure, it may result in an extension of design flexibility.

For example, the stopping jaw 130 may be designed to have various thicknesses.

The stopping jaw 130 may also be designed into various shapes, such as a semicircular shape, a circular shape, a polygonal shape, and the like.

Also, the thickness or diameter of the stopping jaw 130 may be variously designed.

The configurations and methods of the mobile terminal in the aforesaid embodiments may not be limitedly applied, but such embodiments may be configured by a selective combination of all or part of the embodiments so as to implement many variations.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A bobbin comprising:

a main body on which a wire is wound and having two end portions; and a flange portion that protrudes from both end portions of the main body to form an accommodation space for the wire, wherein the main body comprises:

a first winding portion and a second winding portion having different diameters and arranged such that central axes of the first and second winding portions are aligned, the first and second winding portions stepped from each other due to the difference in diameters; and a stopping portion that protrudes from the winding portion of the first and second winding portions having a greater diameter and having two end portions, and wherein both end portions of the stopping portion are spaced from each other along a circumferential direction on an outer circumferential surface of the winding portion having the greater diameter such that the wire is wound starting from the winding portion having a smaller diameter to the winding portion having the greater diameter in order to pass over the stopping portion.

2. The bobbin of claim 1, wherein the stopping portion is located at an end of the first or second winding portion.

3. The bobbin of claim 2, wherein the winding portion having the greater diameter comprises an auxiliary stopping portion that is spaced from the stopping portion in an axial direction.

4. The bobbin of claim 2, wherein the stopping portion is integrally formed with the first or second winding portion.

5. The bobbin of claim 3, wherein the stopping portion is integrally formed with the first or second winding portion.

6. The bobbin of claim 1, wherein the stopping portion is formed in an annular shape on an outer circumferential surface of the winding portion having the greater diameter.

7. The bobbin of claim 6, wherein:

one end of the stopping portion has an opening; and the wire is inserted into the opening and restricted from moving in an axial direction by the stooping portion.

8. The bobbin of claim 7, wherein the stopping portion is integrally formed with the first or second winding portion.

9. The bobbin of claim 6, wherein the stopping portion is integrally formed with the first or second winding portion.

10. The bobbin of claim 1, wherein the stopping portion is integrally formed with the first or second winding portion.

11. A bobbin comprising:

a main body on which a wire is wound and having two end portions; and a flange portion that protrudes from both end portions of the main body to form an accommodation space for the wire, wherein the main body comprises:

a first winding portion and a second winding portion having different diameters and arranged such that central axes of the first and second winding portions are aligned, the first and second winding portions stepped from each other due to the difference in diameters; and a stopping portion that protrudes from the winding portion of the first and second winding portions having a greater diameter and having two end portions, wherein a slot is formed on an outer circumferential surface of the first or second winding portion, and wherein an insertion portion is formed on an inner circumferential surface of the stopping portion and inserted into the slot.

* * * * *